US005999095A

United States Patent [19]

Earl et al.

[11] Patent Number: 5,999,095

[45] Date of Patent: Dec. 7, 1999

[54] ELECTRONIC SECURITY SYSTEM

[75] Inventors: Mark J. Earl; Antonio P. Valenzuela, both of Salem; Michael C. Toll, Keizer; Wayne F. Larson, Salem, all of Oreg.

[73] Assignee: SLC Technologies, Inc., Salem, Oreg.

[21] Appl. No.: 09/086,971

[22] Filed: May 29, 1998

Related U.S. Application Data

[63] Continuation-in-part of application No. 08/748,194, Nov. 12, 1996, Pat. No. 5,758,522, application No. 08/746,322, Nov. 12, 1996, application No. 09/067,353, Apr. 27, 1998, and application No. 08/846,040, Apr. 25, 1997, which is a continuation of application No. 08/444,613, May 19, 1995, abandoned, said application No. 08/746,322, is a continuation-in-part of application No. 08/444,613

[60] Provisional application No. 60/009,920, Jan. 16, 1996.

[51] Int. Cl.[6] ..... E05B 45/06

[52] U.S. Cl. ..... 340/542; 70/DIG. 49; 70/278; 235/382; 340/543; 340/825.31; 361/172; 379/102.06

[58] Field of Search ..... 340/542, 543, 340/825.31, 825.32, 825.34, 528, 545.1, 545.6, 506; 235/382, 382.5; 361/172; 379/102.06; 70/DIG. 49, 271, 278, 423, 425, 427

[56] References Cited

U.S. PATENT DOCUMENTS

| | | | |
|---|---|---|---|
| 3,812,403 | 5/1974 | Gartner | 70/278 X |
| 3,828,340 | 8/1974 | Bauer, Jr. et al. | 340/542 |
| 4,250,533 | 2/1981 | Nelson | 361/172 |
| 4,327,353 | 4/1982 | Beard et al. | 340/543 X |
| 4,635,035 | 1/1987 | Ratzabi | 340/542 X |
| 4,677,284 | 6/1987 | Genest | 235/382 X |
| 4,755,799 | 7/1988 | Romano | 340/543 |
| 4,851,652 | 7/1989 | Imran | 235/382 |
| 4,864,115 | 9/1989 | Imran et al. | 235/492 |
| 4,926,160 | 5/1990 | Hwang | 340/426 |
| 4,967,305 | 10/1990 | Murrer et al. | 361/172 |
| 5,245,652 | 9/1993 | Larson et al. | 379/102.06 |
| 5,280,518 | 1/1994 | Danler et al. | 379/102.06 |
| 5,550,529 | 8/1996 | Burge | 340/542 X |
| 5,701,828 | 12/1997 | Benore et al. | 70/278 X |
| 5,758,522 | 6/1998 | York | 70/63 |
| 5,801,625 | 9/1998 | Wang | 340/506 |

*Primary Examiner*—Thomas Mullen
*Attorney, Agent, or Firm*—Klarquist Sparkman Campbell Leigh & Whinston LLP

[57] ABSTRACT

An access control unit for an electrified door lock also toggles the state of an associated alarm. The unit is arranged to unlock the door only temporarily, but the alarm state is not toggled except by user request. The system is arranged to prevent the anomalous situation of an unlocked door and an armed alarm. Another aspect is the use of standardized key-receiving nests in disparate types of access control devices. Some disparate devices employ identical key-receiving nests, while others use different forms of nests. Yet all mate with and respond to a single type of key.

14 Claims, 1 Drawing Sheet

ELECTRONIC SECURITY SYSTEM

RELATED APPLICATION DATA

This application is a continuation-in-part of the following applications: allowed application Ser. No. 08/748,194, filed Nov. 12, 1996 (now U.S. Pat. No. 5,758,522); application Ser. No. 08/846,040, filed Apr. 25, 1997 (which is a continuation of application Ser. No. 08/444,613, filed May 19, 1995, now abandoned); application Ser. No. 08/746,322, filed Nov. 12, 1996 (which claims priority from provisional application Ser. No. 60/009,920, filed Jan. 16, 1996, and is a continuation-in-part of application Ser. No. 08/444,613 filed May 19, 1995, now abandoned); and copending application Ser. No. 09/067,353, filed Apr. 27, 1998. The subject matter of this application also relates to that of the assignee's U.S. Pat. No. 5,550,529. The foregoing applications and patents are incorporated by reference.

FIELD OF THE INVENTION

The present invention relates to electronic access control devices and systems employing same. In one aspect, the invention relates to an interface apparatus enabling a single electronic key to connect with a variety of different types of locking devices of an electronic access control system. In another aspect, the invention relates to systems for controlling the state of an alarm in order to maintain a desired relationship with the state of an associated lock.

BACKGROUND AND SUMMARY OF THE INVENTION

The related applications detail a variety of electronic access systems. Many are characterized by a variety of disparate lock types (e.g. padlocks, door locks, vaults), each of which is operable by a common electronic key.

In accordance with one aspect of the present invention, a key nest is provided that is well suited for use on locks of disparate types. The nest forms a recess for receiving part of the key, and desirably holding same in place. One or more electrical connectors in the nest establish contact with one or more corresponding contacts on the key.

In accordance with another aspect of the invention, a door lock controller is integrated with an alarm controller, so that a user needn't separately deal with both the door lock and an alarm console when entering and leaving a building.

In many prior art systems, the door lock controller and the alarm controller are separate units. A user entering a secured facility first operates the electronic door lock. Once the door is opened, the user has a brief period (e.g. 30 seconds) within which to disarm the alarm (e.g. by entering a PIN number). On leaving the building the reverse sequence occurs. First the user re-arms the alarm (e.g. by re-entry of the PIN number). A brief delay period then follows before the alarm takes effect, allowing the user to exit the building. Once outside the building, the user re-locks the door.

One improvement to such systems is to integrate the door lock controller and the alarm controller. By such arrangement, unlocking the door also disarms the alarm. Similarly, locking the door re-arms the alarm.

A further improvement to such systems is to arrange the lock to automatically re-lock after a brief period. This improvement, however, introduces a problem: keeping the state of the alarm in synchrony with the door lock.

Consider the case of a delivery entrance to a fast food restaurant. Some suppliers may make deliveries to the restaurant before any employees arrive, and so are provided with their own keys. To track the coming and going of such suppliers, restaurants are increasingly using electronic door locks that compile a log of lock activity, detailing the particular keyholders who open the door, together with the dates and times of such accesses.

The way such a system is supposed to work is that the supplier arrives and engages the key with a lock controller mounted outside the building. So doing toggles the state of a first relay (or switching circuitry) controlling a door lock solenoid or motor, switching the door lock from locked to unlocked. So doing also toggles the state of a second relay (or switching circuitry) controlling the alarm state, switching the alarm from armed to disarmed. The supplier then makes the delivery. Prior to driving away, the supplier engages the key with the lock controller a second time. So doing toggles the first relay back to locking the door, and toggles the second relay back to arming the alarm.

While restaurants strictly admonish their suppliers to follow this procedure, it is desirable to take precautionary steps in case a supplier forgets. In particular, restaurants want to guard against the possibility of the door being left unlocked if the supplier neglects to relock the door prior to departing. To provide a fail-safe situation, such door locks can be made to automatically re-lock after a brief interval.

Unfortunately, the alarm cannot similarly be automatically re-armed. (I.e. the door lock and alarm cannot be controlled by the same relay/switching circuit). The supplier may still be unloading supplies, or may be otherwise occupied inside the premises. Automatically re-arming the alarm whenever the door is automatically re-locked would cause numerous false alarms. Accordingly, a situation can arise where the door is locked, yet the alarm is disarmed.

If a supplier leaves the restaurant in this anomalous state, and a second supplier then visits, a false alarm is likely to occur. When the second supplier engages the key with the lock, this toggles the door lock from locked to unlocked. But it also toggles the alarm from disarmed to armed. When the second supplier enters the restaurant, the motion is detected by the armed alarm system and an alarm is sounded.

In accordance with a second aspect of the present invention, the foregoing problem is solved. One embodiment detects the anomalous state and, when a key is next presented to the lock, the door lock is opened but the alarm state is not changed. In a particular embodiment, this operation is performed in two phases. In the first, the state of the alarm is toggled back to armed while the door remains locked. In the second, the states of both the lock and the alarm are toggled, e.g. to unlocked and dis-armed. By this arrangement, security is enhanced against human error, without increasing the possibility of false alarms.

The foregoing and additional features and advantages of the invention will be more readily apparent from the following detailed description, which proceeds with reference to the accompanying drawings.

DETAILED DESCRIPTION

The inventions detailed below are illustrated with reference to an exemplary embodiment, namely the assignee's TRACcess brand of access control devices. However, it should be remembered that the inventions are not thereby limited, but instead are defined solely by the appended claims.

The illustrative TRACcess system includes a family of access control devices, each operable by a common key. Individual devices include padlocks, door locks, keyboxes, vaults, etc. Additionally, the family includes a generic controller unit, termed a TRAC-Station, which can be used to provide keyed control of any electrical circuit. The TRAC-Station unit can be employed, for example, to control power application to large industrial machinery (e.g. paper making machines, printing presses), to serve as a vehicle starter interrupter, to permit fire department control of building elevator systems, to provide controlled access to police evidence lockers, hospital drug cabinets, and electrical/telephone vaults/boxes, to permit service access to Automatic Teller Machines, to permit postal employee access to mail boxes, etc., etc. One popular use for the TRAC-Station is to retrofit existing electric door locks so as to provide access tracking and other features.

Access tracking refers to the capability of TRACcess system components to store the date and time of all access activities, together with the ID of the key making (or attempting to make) the access. Other features of the TRACcess system are detailed in the cited patents and applications, and in the assignee's U.S. Pat. Nos. 5,705,991, 5,475,375, 5,280,518, 5,046,084, 4,800,255, 4,851,652, 4,864,115, and 4,967,305, the disclosures of which are incorporated by reference. Briefly, these further features include: a single key that can work with access devices of disparate types; keys that automatically expire after a predetermined period unless timely renewed; logging of access data in keys as well as the access control devices; forced downloading of access data from keys to a central database (TRACcess Information Management system, or TIM) as a condition of key renewal; acoustic transfer of data from keys to TIM by telephone; selective lockout of any key from any access device; provision of operating power from keys to access devices so as to avoid the need for commercial power, etc., etc.

The following discussion focuses on the TRAC-Station unit—the generic controller that can be employed to provide keyed control of any electronic circuit. In particular, the discussion details use of the TRAC-Station unit to controllably apply and remove power to a door unlocking solenoid associated with a pre-existing electric door lock.

Figure 1:
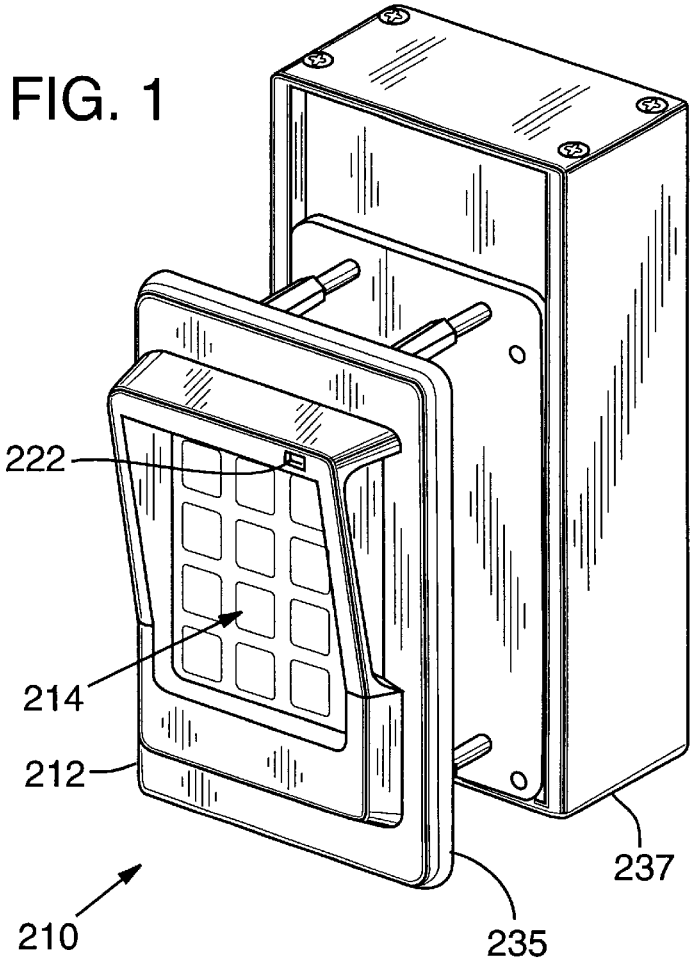
FIG. 1 shows a TRAC-Station unit according to one embodiment of the invention.
Figure 2:
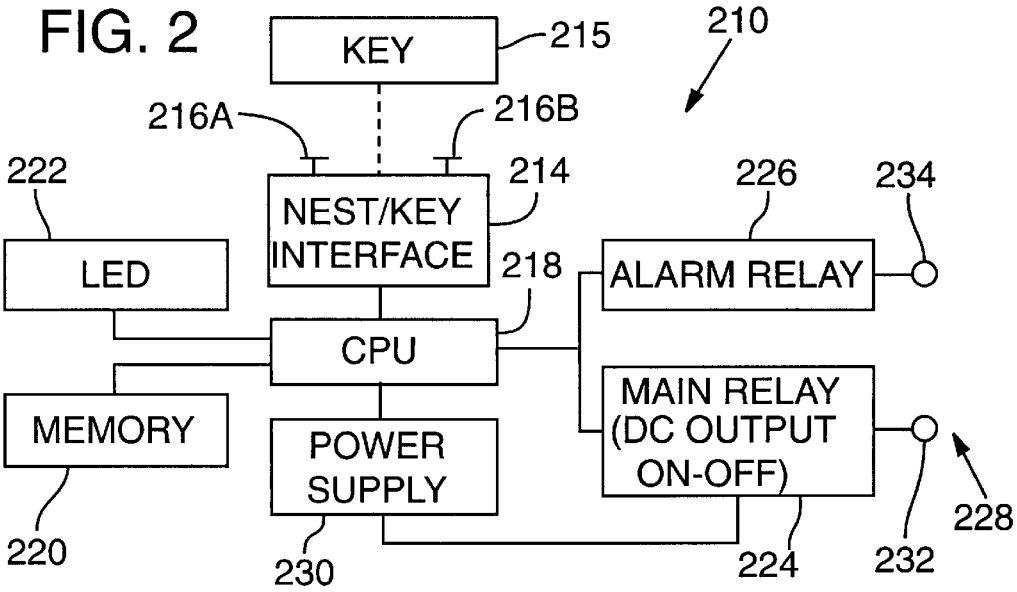
FIG. 2 is a block diagram of the unit of FIG. 1.

As shown in FIGS. 1 and 2, the TRAC-Station unit 210 includes a housing 212 having a recess (nest) 214 sized to receive an electronic key 215. (Key 215 is detailed in the assignee's cited patents and applications.) The four walls of the nest cooperate to hold the key in place without the need for separately operable latches or the like to keep the key in place. Contacts on the back of key 215 mate with corresponding contacts 216A, 216B inside the nest to provide electrical connection between the key and TRAC-Station unit. The TRAC-Station unit further includes a CPU 218, memory 220, a bi-color LED 222, a main relay 224, and an alarm relay 226 (a latching relay). The CPU is a PIC 16C73A, available from Microchip. The CPU includes 4K of onboard program memory, and 192 bytes of data memory. Memory 220 is a 2K serial EEPROM.

Unlike the other components in the TRACcess family, the TRAC-Station does not receive its operating power exclusively from the key. Instead, a power supply 230 provides the operating power needed by the unit. In the illustrated embodiment, power supply 230 is a switching power supply provided with a 14–36 volt input signal, and providing 12 and 24 volt output signals. A backup battery pack can also be employed (e.g. an array of eight AA batteries) in case the input 14–36 volt signal fails. The TRAC-Station CPU 218 and memory 220 initially receive their power (less than a quarter watt) from the key through contacts 216A and 216B. (Once the key is removed, the CPU and memory receive the balance of their power from power supply 230.)

A terminal block associated with the TRAC-Station unit provides screw-terminal connections 228 for external wiring. Among these connections are DC output terminals 232 to which positive and negative voltages are controllably applied by relay 224 for a predetermined interval (e.g. one second to one minute) to control the associated equipment (e.g. the door unlocking solenoid). The output voltage (12 or 24 volts) is user-selectable by DIP switches. Other connections 234 include the single pole and two throw (normally open and normally closed) contacts for the latching alarm interface relay 226.

The TRAC-Station unit has two parts. When used to control a door lock, a first, nest portion 235 is mounted adjacent the outside of the door. A second, control portion 237 is mounted inside the secured area and is coupled to the first by a wiring cable. The relays and terminal block are part of the second portion. The components are distributed between the two portions so that, even if the nest portion is vandalized and its internal wiring is made accessible, the lock still cannot be opened. (One way of distributing the electrical components is to have all components, except contacts 216A/216B and LED 222, in the second portion.) A typical operation sequence is as follows:

1. The user presents the key to the TRAC-Station unit (i.e. the user inserts the key 215 into the nest 214 of the TRAC-Station unit 210, and enters a PIN code into the key).

2. The key provides the TRAC-Station unit with appropriate authorization information, and the TRAC-Station unit validates this information.

3. If the key is unauthorized, it emits a "problem" tone through a built-in transducer.

4. If the key is authorized, the TRAC-Station unit applies power to output terminals 232 (thereby powering the door unlocking solenoid) and toggles the alarm relay (i.e. to its dis-armed state). The unit also records these operations in its memory, together with the date/time, and keyholder ID. Additionally, power supply 230 takes over from key 215 to provide power to the CPU 218 and memory 220.

5. A green flashing light from LED 222 signals the user that the TRAC-Station has successfully been activated.

6. Once the TRAC-Station unit is activated, the user can remove the key and pass through the door.

7. After the predetermined period, the TRAC-Station unit terminates its activation operation (e.g. de-activating relay 224, returning the door locking solenoid to its locked position), and logs the deactivation in its memory.

If the user withdraws the key prior to successful initiation of the TRAC-Station output function, and key will emit an error tone. Similarly, such a tone will be emitted if the TRAC-Station determines that the key has incorrect authorization. If the key battery is low, the TRAC-Station will operate, but will display a flashing red, instead of green, light to signal initiation of the output function.

When the user leaves the premises, a similar series of steps occurs:

1. The user again presents the key to the TRAC-Station unit.

2. The key provides the TRAC-Station unit with appropriate authorization information, and the TRAC-Station unit validates this information.

3. If the key is unauthorized, it emits a "problem" tone through a built-in transducer.

4. If the key is authorized, the TRAC-Station unit toggles the alarm relay 226 (i.e. back to armed"), and records the operation in its memory.

5. LED 222 provides a solid red light for a brief interval (e.g. three seconds) to signal the user that these operations have completed successfully.

If the user attempts the foregoing steps during the TRAC-Station unit's predetermined activation period, the key will emit an error tone. That is, the user cannot toggle the alarm state back to armed until the TRAC-Station has terminated its activation of relay 224.

The TRAC-Station has two modes of operation.

As noted earlier, a problem arises when, as here, a door lock automatically relocks after a predetermined interval: the alarm state may be out of synchrony with the lock state. To overcome this problem, the preferred embodiment recognizes the anomalous condition (door locked, alarm disarmed) and does not toggle the alarm to the armed state when a key is next presented to the TRAC-Station unit. This is the first mode of operation.

In the preferred embodiment, this operation is implemented as follows. When a user presents a key to a TRAC-Station unit, and the alarm is already disarmed, the TRAC-Station undergoes a first, resynchronizing phase of operation in which it responds by re-arming the alarm but not unlocking the door. This phase of operation is logged in the TRAC-Station memory. LED 222 glows solid red for three seconds to indicate that this resynchronizing operation has taken place. The solid red LED prompts the user to present the key a second time to the TRAC-Station unit. On the second presentation, the TRAC-Station responds as described above, unlocking the door for the predetermined period, and toggling the alarm state (i.e. now to dis-armed).

In the second mode of operation, the resynchronization phase is skipped. Presentation of a key always (1) unlocks the door for the predetermined period, and (2) toggles the alarm relay to its assigned normally-open state at the beginning of the activation cycle, then back to its normally closed state at the end of the activation cycle.

(In other embodiments, the controller unit can have just the first mode of operation.)

As is well understood by those skilled in the microprocessor control arts, the foregoing operations are effected by corresponding program and data instructions stored in CPU 218 and memory 220.

The data logging features of the TRACcess system permit identification of keyholders who do not use their key when leaving a building (thus leaving the alarm in the dis-armed state). This information can be used by the lock proprietor to remind the offending keyholder of the correct procedures.

As will also be apparent to those skilled in the art, the foregoing concepts can be employed in applications quite diverse from that particularly illustrated; the detailed embodiment is exemplary only. For example, a key is not necessary. The foregoing alarm synchronization concept is equally applicable to keyless security systems, such as those employing a code pad at the door, or a speech recognition unit, a biometric sensor, etc. Similarly, coupling between the key and the unit need not be by electrical contact If a key is used, it can be coupled to the controller unit by radio, infrared, ultrasonics, optoelectronics, etc. Alternatively, a magnetic stripe key and reader can be employed. Instead of an LED, other feedback devices can be used, such as the audio transducer often provided on the key, or an audio transducer associated with the TRAC-Station unit.

The illustrated TRAC-station unit is well suited to retrofitting existing electric locks, to provide the access tracking and other features discussed above.

In the just-discussed TRAC-Station embodiment, the key nest receives the back of the key. This allows the TRAC-Station unit to have a low profile. The same arrangement is employed in the TRACcess vault, as detailed in allowed copending application Ser. No. 08/748,194. In other components of the TRACcess family (e.g. the padlock and keybox), the nest is located in the bottom of the device and receives the top of the key. The key is arranged so that its two electrical contacts are accessible in both types of key nests, permitting this flexibility. (The arrangement of a key top-receiving nest, and the arrangement of key contacts permitting access from both the top and back sides, is detailed in parent application Ser. No. 09/067,353.)

Having described the principles of our invention with reference to several preferred embodiments and variations thereon, it should be apparent that the invention can be modified in arrangement and detail without departing from such principles.

Although the preferred embodiment has been described as including certain combinations of features, our invention includes alternative embodiments that include other combinations of the features disclosed herein and in the documents incorporated by reference.

Accordingly, it should be recognized that the foregoing embodiments are illustrative only and should not be taken as limiting the scope of the invention. Rather, we claim as our invention all such modifications as may come within the scope and spirit of the following claims and equivalents thereto.

We claim:

1. An access control system including an electronic key and plural access control devices responsive thereto, at least one of said access control devices being a controller for applying an electrical signal to an electric door lock in response to a properly authorized key, the controller also including a switching circuit for switching a control signal of an associated alarm unit to switch same between armed and dis-armed states, the system including means for preventing false alarms due to lack of synchronization between states of the door lock and the alarm unit.

2. The system of claim 1 in which another of said access control devices is a member of the group consisting of a vault, a keybox, and a padlock.

3. The system of claim 2 including a vault, said vault including means controllably coupling a manual actuator member to a locking bolt in response to said key.

4. The system of claim 2 including a padlock, said padlock including means aiding reliable operation even after extended periods of non-use.

5. Apparatus comprising:

an input device used by a user to solicit entry to a secured area, the area being secured by an access control device having locked and unlocked states;

a verifier for determining whether the user is authorized to enter the secure area, the verifier receiving signals from the input device, and producing a first output signal if the user is determined to be authorized;

a first circuit for controllably unlocking the access control device in response to the first signal from the verifier;

a second circuit for controllably changing an alarm unit between armed and disarmed states; and a controller coupled to at least one of the first or second circuits, preventing a disallowed state of an unlocked access control device with an armed alarm unit.

6. The apparatus of claim 5 in which the second circuit controllably changes the alarm state in response, in part, to the first signal from the verifier.

7. A method of operating a lock/alarm controller comprising:

(a) receiving a first signal from a user;

(b) in response to said first signal, unlocking a door and toggling an alarm state to dis-armed;

(c) automatically re-locking the door a predetermined period after said unlocking;

(d) receiving a second signal from a user;

(e) in response to said second signal, toggling an alarm state to armed;

wherein the method does not result in the door being unlocked and the alarm armed.

8. The method of claim 7 which further includes providing a confirmation signal to the user as part of said response to the first signal.

9. The method of claim 7 which further includes providing a confirmation signal to the user as part of said response to the second signal.

10. The method of claim 9 in which the confirmation signal is visual.

11. The method of claim 9 in which the confirmation signal is audible.

12. An access control system including an electronic key and first and second access control devices, the key having plural sides each lying in a different plane, and at least first and second electrical key contacts for exchanging electrical signals between circuitry internal to the key and external circuitry coupled through the contacts to said key, the first access device including a nest for receiving a first side of the key, the second access device including a nest for receiving a second side of the key different from the first, both of said nests including contacts for establishing contact with said key contacts.

13. Apparatus comprising:

first and second electronic locking devices, one of said devices being configured for locking a small article in a metal box, the other of said devices being configured for controlling a locking member that restricts human access to a secured area and not for securing a small article in a metal box;

a first interface member defining a nest into which fits an electronic key, the first interface member being attached to the first locking device;

a second interface member defining a nest into which fits an electronic key, the second interface member being attached to the second locking device;

wherein both of said interface members permit the same key to be used therewith to open the associated locking devices, and wherein the nests of the first and second interface members have different shapes, for receiving different portions of the electronic key.

14. The apparatus of claim 13 in which one of the locking devices is an electronic padlock used to restrict human access to a secured area, said padlock including means aiding reliable operation even after extended periods of non-use.

* * * * *